US009926756B2

(12) United States Patent
Wesemeier et al.

(10) Patent No.: US 9,926,756 B2
(45) Date of Patent: Mar. 27, 2018

(54) PRESSURE COMPENSATION MODULES FOR CORING TOOLS, CORING TOOLS INCLUDING PRESSURE COMPENSATION MODULES, AND RELATED METHODS

(71) Applicant: Baker Hughes Incorporated, Houston, TX (US)

(72) Inventors: Christoph Wesemeier, Hannover (DE); Thomas Uhlenberg, Niedersachsen (DE)

(73) Assignee: Baker Hughes Incorporated, Houston, TX (US)

( * ) Notice: Subject to any disclaimer, the term of this patent is extended or adjusted under 35 U.S.C. 154(b) by 609 days.

(21) Appl. No.: 14/334,238

(22) Filed: Jul. 17, 2014

(65) Prior Publication Data

US 2015/0021097 A1 Jan. 22, 2015

Related U.S. Application Data

(60) Provisional application No. 61/847,915, filed on Jul. 18, 2013.

(51) Int. Cl.

| | |
|---|---|
| ***E21B 49/08*** | (2006.01) |
| ***E21B 25/00*** | (2006.01) |
| ***E21B 25/08*** | (2006.01) |

(52) U.S. Cl.

CPC ..... *E21B 25/00* (2013.01); *E21B 25/08* (2013.01)

(58) Field of Classification Search

CPC ..... E21B 25/08; E21B 25/00; E21B 25/06
See application file for complete search history.

(56) References Cited

U.S. PATENT DOCUMENTS 2,862,691 A * 12/1958 Cochran ..... E21B 25/08 175/226
3,207,239 A 9/1965 Hugel
3,207,240 A * 9/1965 Hugel ..... E21B 25/08 175/226
4,230,192 A * 10/1980 Pfannkuche ..... E21B 25/08 175/233

(Continued)

FOREIGN PATENT DOCUMENTS

| | | | |
|---|---|---|---|
| JP | 2005030196 | A | 2/2005 |
| JP | 2005240308 | A | 9/2005 |
| WO | 2015038143 | A1 | 3/2015 |

OTHER PUBLICATIONS

International Search Report for International Application No. PCT/US2014/047168 dated Nov. 6, 2014, 3 pages.

(Continued)

*Primary Examiner* — Daniel P Stephenson
(74) *Attorney, Agent, or Firm* — TraskBritt

(57) ABSTRACT

Methods of compensating pressure differences between interiors and exteriors of inner barrels of coring tools may involve advancing a coring tool into a wellbore, the coring tool comprising an inner barrel for receiving a core sample cut by the coring tool, a first fluid being sealed within the inner barrel. A second fluid may flow along an exterior of the inner barrel. A pressure difference between the first fluid and the second fluid may be reduced. A volume occupied by the first fluid may be compressed by moving a compensating member. The volume occupied by the first fluid may be expanded by moving the compensating member.

18 Claims, 6 Drawing Sheets

(56) References Cited

U.S. PATENT DOCUMENTS

| | | | | |
|---|---|---|---|---|
| 4,258,803 | A * | 3/1981 | Thompson | E21B 25/08 175/233 |
| 4,272,987 | A * | 6/1981 | Aumann | E21B 25/08 73/152.11 |
| 4,598,777 | A | 7/1986 | Park et al. | |
| 5,482,123 | A | 1/1996 | Collee | |
| 6,283,228 | B2 * | 9/2001 | Collee | E21B 25/08 175/226 |
| 6,695,075 | B2 * | 2/2004 | Beeker | E02D 1/04 175/226 |
| 6,719,070 | B1 | 4/2004 | Puymbroeck et al. | |
| 7,124,841 | B2 * | 10/2006 | Wada | E21B 25/18 175/226 |
| 8,499,856 | B2 * | 8/2013 | Kumar | E21B 25/00 175/226 |
| 2003/0089526 | A1 * | 5/2003 | Beeker | E02D 1/04 175/58 |
| 2005/0133267 | A1 * | 6/2005 | Reid, Jr. | E21B 49/06 175/58 |
| 2006/0169496 | A1 | 8/2006 | Puymbroeck et al. | |
| 2011/0253452 | A1 | 10/2011 | Beuershausen et al. | |
| 2014/0262527 | A1 * | 9/2014 | Rothenwaender | E21B 25/08 175/58 |
| 2015/0021096 | A1 * | 1/2015 | Wesemeier | E21B 25/08 175/58 |
| 2015/0021097 | A1 * | 1/2015 | Wesemeier | E21B 25/00 175/59 |
| 2016/0060986 | A1 * | 3/2016 | Wesemeier | E21B 25/00 175/58 |
| 2016/0194928 | A1 * | 7/2016 | Delmar | E21B 25/06 175/58 |

OTHER PUBLICATIONS

International Written Opinion for International Application No. PCT/US2014/047168 dated Nov. 6, 2014, 6 pages.

Extended European Search Report for EP Application No. 14827097.8 dated Feb. 27, 2017, 10 pages.

Canadian Office Action for Canadian Application No. 2,918,700 dated Jan. 31, 2017, 3 pages.

* cited by examiner

PRESSURE COMPENSATION MODULES FOR CORING TOOLS, CORING TOOLS INCLUDING PRESSURE COMPENSATION MODULES, AND RELATED METHODS

CROSS-REFERENCE TO RELATED APPLICATIONS

This application claims the benefit of U.S. Provisional Patent Application Ser. No. 61/847,915, filed Jul. 18, 2013, and entitled "PRESSURE COMPENSATION MODULES FOR CORING TOOLS, CORING TOOLS INCLUDING PRESSURE COMPENSATION MODULES, AND RELATED METHODS," the disclosure of which is incorporated herein in its entirety by this reference.

FIELD

The disclosure relates generally to pressure compensation modules for coring tools. More specifically, disclosed embodiments relate to pressure compensation modules that may equalize pressure differentials between presaturation fluid located within a receptacle for receiving a core sample and drilling fluid circulating at an exterior of the receptacle.

BACKGROUND

When evaluating whether a given earth formation contains valuable materials, such as hydrocarbons, a core sample from the earth formation may be procured. When the core sample is returned to the surface, the core sample, any fluids entrapped within the core sample, and any fluids that escaped the core sample but were captured by the coring tool may be analyzed to determine the characteristics exhibited by the earth formation. To ensure that the coring tool more accurately represents the actual characteristics of an earth formation at the end of a borehole, steps are taken to reduce the likelihood that contaminants enter a receptacle that is to receive the core sample. For example, an entrance to the receptacle may be sealed shut while advancing the coring tool into the borehole to reduce the likelihood that materials other than the core sample (e.g., drilling fluid and particles suspended within the drilling fluid) enter the receptacle and contaminate the receptacle, the core sample, or any other material in the receptacle. The entrance to the receptacle may be sealed shut by, for example, an activation module that is intended to block the entrance to the receptacle while the coring tool is advanced into the borehole and to unblock the entrance to the receptacle as a core sample is introduced into the receptacle. As a further example, the receptacle may be substantially emptied of material and then filled, and potentially pressurized, with a presaturation fluid (i.e., a fluid of known composition that will not contaminate the core sample) before the coring tool is introduced into the borehole. The presaturation fluid may be a fluid that is not wettable to a sponge material lining the interior of the receptacle, the sponge material being wettable to a fluid of interest expected to be found within the core sample, such as oil.

BRIEF SUMMARY

In some embodiments, coring systems may include a coring bit configured to cut a core sample from an earth formation and an inner barrel connected to the coring bit, the inner barrel comprising a receptacle configured to receive the core sample. A first fluid may be configured to presaturate the receptacle. A second fluid may be configured to cool and lubricate the coring bit. A compensation module may be positioned between the first fluid and the second fluid. The compensation module may be configured to reduce pressure differences between the first fluid and the second fluid over a range of pressure differences. The compensation module may include: a fluid boundary connected to the inner barrel and positioned to seal the first fluid from the second fluid. The fluid boundary may be movable to enable expansion or compression of the first fluid in response to pressure differences across the fluid boundary.

In other embodiments, methods of making coring systems may involve configuring a coring bit to cut a core out of an earth formation and connecting an inner barrel comprising a receptacle configured to receive the core sample to the coring bit. The receptacle may be presaturated utilizing a first fluid. A second fluid may be provided to cool and lubricate the coring bit. A compensation module may be positioned between the first fluid and the second fluid, the compensation module being configured to reduce pressure differences between the first fluid and the second fluid over a range of pressure differences. The compensation module may include a fluid boundary connected to the inner barrel and positioned to seal the first fluid from the second fluid. The fluid boundary may be movable to enable expansion or compression of the first fluid in response to pressure differences across the fluid boundary.

In still other embodiments, compensation units for coring tools may include a compensation module configured to reduce pressure differences between an interior of an inner barrel and an exterior of the inner barrel over a range of pressure differences. The compensation module may include a compensator housing including a bore extending through the compensator housing. A compensating member may be connected to the compensator housing, a seal being formed between the compensating member and a surface of the compensator housing. A first volume on a first side of the compensating member may be configured to contain a first fluid within the inner barrel and a second volume on a second side of the compensating member may be configured to be exposed to a second fluid. At least a portion of the compensating member may be movable with respect to the compensator housing to reduce pressure differences across the compensating member over the range of pressure differences.

In yet other embodiments, methods of compensating pressure differences between interiors and exteriors of inner barrels of coring tools may involve advancing a coring tool into a wellbore, the coring tool comprising an inner barrel configured to receive a core sample cut by the coring tool, the inner barrel comprising a first fluid sealed within the inner barrel. A second fluid may flow along an exterior of the inner barrel, the second fluid configured to cool and lubricate at least a portion of the coring tool. A pressure difference between the first fluid and the second fluid may be reduced over a range of pressure differences. A volume occupied by the first fluid may be compressed by moving at least a portion of a compensating member in a first direction in response to a pressure difference across the compensating member, the compensating member sealably connected to the inner barrel, the compensating member being exposed to the first fluid on a first side of the compensating member and exposed to the second fluid on a second, opposing side of the compensating member. The volume occupied by the first fluid may be expanded by moving the at least a portion of the compensating member in a second direction in response to a pressure difference across the compensating member.

BRIEF DESCRIPTION OF THE DRAWINGS

While the disclosure concludes with claims particularly pointing out and distinctly claiming specific embodiments, various features and advantages of embodiments of the disclosure may be more readily ascertained from the following description when read in conjunction with the accompanying drawings, in which:

DETAILED DESCRIPTION

The illustrations presented herein are not meant to be actual views of any particular compensation module, coring tool, or component thereof, but are merely idealized representations employed to describe illustrative embodiments. Thus, the drawings are not necessarily to scale.

Disclosed embodiments relate generally to pressure compensation modules that may equalize pressure differentials between presaturation fluid located within a receptacle for receiving a core sample and drilling fluid circulating at an exterior of the receptacle. More specifically, disclosed are pressure compensation modules that may reduce the likelihood that an activation module will be prematurely activated due to pressure differentials between the presaturation fluid and the drilling fluid, unsealing an entrance to a receptacle of a coring tool and contaminating the receptacle.

Figure 1:
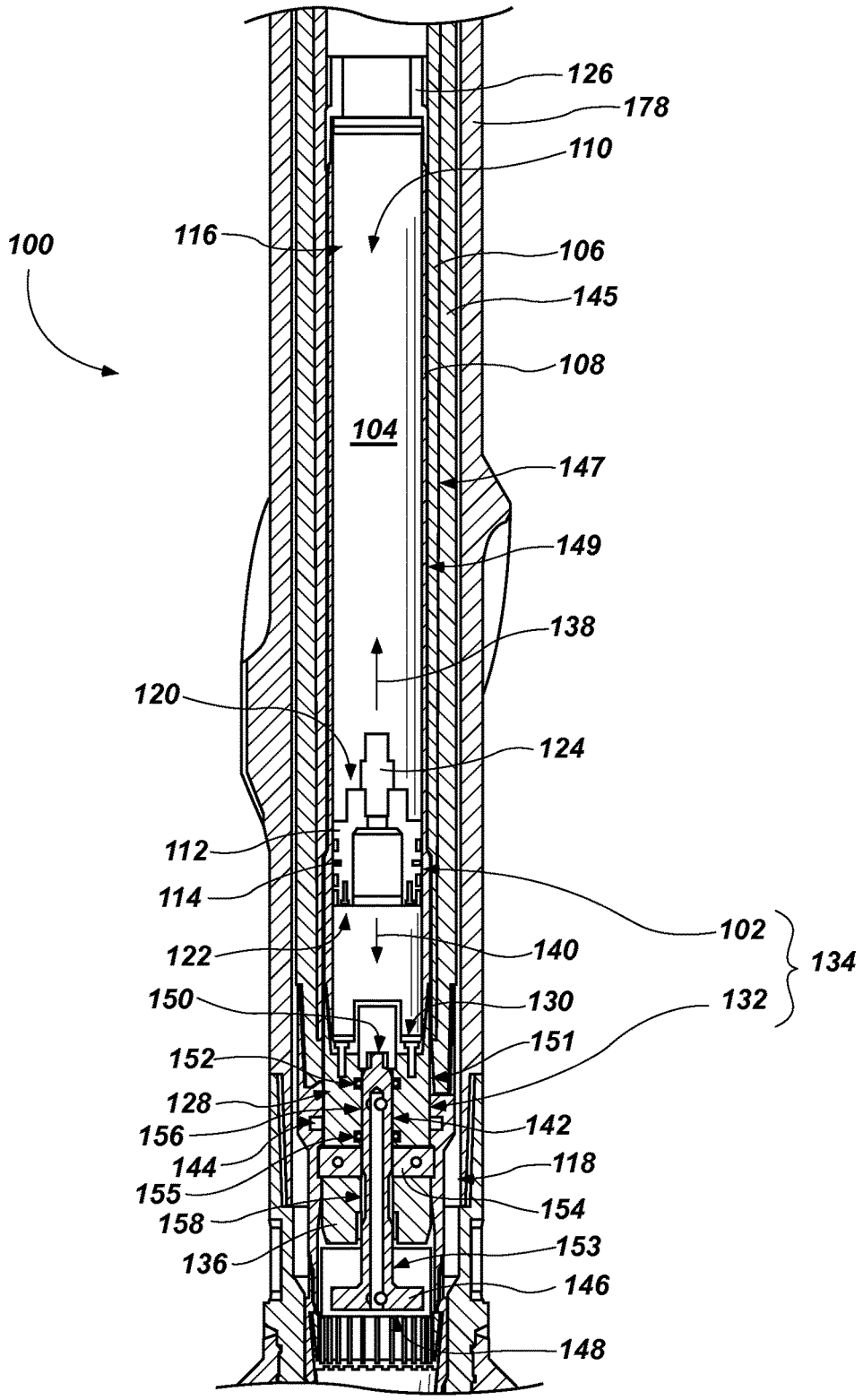
FIG. 1 is a cross-sectional view of a portion of a coring tool depicting a pressure compensation module of the coring tool.

Referring to FIG. 1, cross-sectional view of a portion of a coring tool 100 depicting a pressure compensation module 102 of the coring tool 100 is shown. The compensation module 102 may be configured to reduce (e.g., minimize or eliminate) pressure differentials between an interior 104 of a receptacle 106 configured to receive a core sample and an exterior of the receptacle 106, at least over a range of pressure differences. The compensation module 102 may be located within the receptacle 106 proximate a lower entrance 128 to the receptacle 106 in some embodiments.

The compensation module 102 may include a compensator housing 108 in some embodiments. The compensator housing 108 may be a generally tubular member sized and configured to be located within the receptacle 106. The compensator housing 108 may include a bore 110 extending longitudinally through the compensator housing 108. The compensation module 102 may further include a movable compensating member, which in some embodiments may be a compensating piston 112 located within the bore 110 of the compensator housing 108. A seal 114 may be formed between the compensating piston 112 and an inner surface 116 (e.g., a wall) of the compensator housing 108, the inner surface 116 defining the bore 110. For example, the seal 114 may be formed using an O-ring configured to contact the inner surface 116 of the compensator housing 108, the O-ring being located within a recess formed in a sidewall of the compensating piston 112. By forming the seal 114 between the compensator housing 108 and the compensating piston 112, a first, upper side 120 of the compensating piston 112 may be isolated from a second, lower side 122 of the compensating piston 112. Thus, the compensating piston 112 may act as the divider between two volumes of fluid, a first volume of presaturation fluid on the first side 120 of the compensating piston 112 and a second volume of drilling fluid on the second side 122 of the compensating piston 112.

The compensating piston 112 may be movable along the compensator housing 108 to reduce (e.g., minimize or eliminate) pressure differentials between the presaturation fluid at the interior 104 of the receptacle 106 and drilling fluid at the exterior 118 of the receptacle 106, at least over a range of pressure differences. For example, the compensating piston 112 may move longitudinally in a first direction, indicated by arrow 138, opposing a direction in which the coring tool 100 is advanced (e.g., longitudinally upward) to compress the presaturation fluid when the pressure of the drilling fluid acting on the second side 122 of the compensating piston 112 is greater than the pressure of the presaturation fluid acting on the first side 120 of the compensating piston 112. Continuing the example, the compensating piston 112 may move longitudinally in a second, same direction, indicated by arrow 140, in which the coring tool 100 is advanced (e.g., longitudinally downward) to expand the presaturation fluid when the pressure of the drilling fluid acting on the second side 122 of the compensating piston 112 is less than the pressure of the presaturation fluid acting on the first side 120 of the compensating piston 112.

The compensating piston 112 may include a one-way pressure relief valve 124 enabling presaturation fluid to flow from the first side 120 of the compensating piston 112 to the second side 122 of the compensating piston 112. Because permitting drilling fluid to enter the receptacle 106 would likely contaminate a core sample later introduced into the receptacle 106, the one-way pressure relief valve 124 may block drilling fluid from flowing from the second side 122 of the compensating piston 112 to the first side 120 of the compensating piston 112. Permitting presaturation fluid to escape from the receptacle 106 into the drilling fluid may enable the compensator module 102 to reduce (e.g., minimize or eliminate) a greater range of pressure differentials. For example, when the pressure of presaturation fluid within the receptacle 106 reaches an upper threshold amount, expansion of the presaturation fluid may cause the compensating piston 112 to move to a lowest extent of travel within the compensator housing 108. If the pressure of presaturation fluid continues to increase with respect to the pressure of the drilling fluid, the presaturation fluid may escape through the one-way pressure relief valve 124 to bring the pressure differential back into equilibrium.

Longitudinal travel of the compensating piston 112 may be limited in some embodiments to define the range of pressure differences over which the compensating piston 112 is enabled to reduce (e.g., minimize or eliminate) pressure differentials between the presaturation fluid and the drilling fluid. For example, the compensator housing 108 may include an upper stop 126 defining an upper travel limit for the compensating piston 112. The upper stop 126 may comprise, for example, a ledge at a constricted diameter as compared to the compensator housing 108 which the compensating piston 112 may contact and stop against. The compensator housing 108 may further include a lower stop 130 defining a lower travel limit for the compensating piston 112. The lower stop 130 may comprise, for example, a plate covering a portion of an end of the compensator housing 108 which the compensating piston 112 may contact and stop against. A total travel distance along which the compensating piston 112 may move may be, for example, between about 0.5 foot (~0.15 m) and about 6 feet (~1.8 m). More specifically, the total travel distance along which the compensating piston 112 may move may be, for example, between about 1 foot (~0.30 m) and about 5 feet (~1.5 m). As a specific, nonlimiting example, the total travel distance along which the compensating piston 112 may move may be between about 2 feet (~0.61 m) and about 4 feet (~1.2 m) (e.g., about 3 feet (~0.91 m).

The compensation module 102 may be associated with an activation module 132 to form a compensation and activation unit 134. For example, the activation module 132 may be attached to the compensation module 102 at a lower end of the compensation module 102. The activation module 132 may be configured to selectively seal the entrance 128 to the receptacle 106. More specifically, the activation module 132 may be configured to seal the entrance 128 to the receptacle 106 shut, and maintain the compensation and activation unit 134 in place, while the coring tool 100 is advanced to the end of a borehole. The activation module 132 may be configured to unblock the entrance 128 to the receptacle 106, and release the compensation and activation unit 134 to travel within the receptacle 106, when a core sample is introduced into the receptacle.

The activation module 132 may include, for example, an activator body 136 sized and configured to occupy the entrance 128 to the receptacle 106. The activator body 136 may be attached to the compensator housing 108, for example, by a threaded connection. The activator body 136 may include, for example, an inner bore 142 extending through the activator body 136. A seal 144 may be formed between the activator body 136 and a component in which the activation module 132 is located, such as, for example, an inner barrel 145 (see FIG. 2) located within an outer barrel 178 or the receptacle 106, which may be accomplished, for example, by providing an O-ring configured to contact the activator body 136 within a recess formed in an inner surface 149 of the receptacle 106, an inner surface 147 of the inner barrel 145 (see FIG. 2), or an outer surface 151 of the activation module 132.

The activation module 132 may further include an activation rod 146 configured to maintain the activation module 132 in place while advancing into a borehole and to release the activation module 132 when a core sample is introduced to the receptacle 106. The activation rod 146 may be partially located within the inner bore 142 of the activator body 136. A seal 152 may be formed between the activation rod 146 and the activator body 136, for example, by positioning an O-ring configured to contact the activation rod 146 within a recess in an inner surface 156 defining the inner bore 142 of the activator body 136 or in an outer surface 153 of the activation rod 146. The activation rod 146 may include a first end 148 configured to be contacted by a core sample and a second, opposing end 150. The first end 148 of the activation rod 146 may be exposed to drilling fluid circulating through the coring tool 100 and the second end 150 of the activation rod 146 may be exposed to presaturation fluid sealed within the receptacle 106. The activation rod 146 may be movable between a first position, in which the activation module 132 is engaged with the seal 144 and blocks the entrance 128 to the receptacle 106, and a second position, in which the activation module 132 is free to disengage from the seal 144 and unblock the entrance 128 to the receptacle 106. For example, the activation module 132 may include locking dogs 154 on opposing sides of the activation rod 146, which may frictionally or mechanically interfere with movement of the activation module 132 when the activation rod 146 is in the first position (shown in FIG. 1). When the activation rod 146 is in the first position, a recess 158 extending into (e.g., around) the activation rod 146 may be misaligned from the locking dogs 154 such that the activation rod 146 does not permit the locking dogs 154 to move radially inward and cease interfering with movement of the activation module 132. When the activation rod 146 moves to the second position (shown in FIG. 6), which may involve moving longitudinally upward as a core sample presses against the first end 148 of the activation rod 146, a recess 158 extending into the activation rod 146 may align with the locking dogs 154, enabling the locking dogs 154 to partially enter the recess 158 and cease interfering with movement of the activation module 132.

The compensation module 102 may be located proximate to the activation module 132. For example, a lowest point of the compensation module 102 may be located 20 feet or less from an uppermost point of the activation module 132. More specifically, the compensation module 102 may be located, for example, adjacent to the activation module 132. As a specific, nonlimiting example, the compensation module 102 may be directly attached to the activation module 132.

In the absence of pressure compensation, because the first and second ends 148 and 150 of the activation rod 146 are exposed to different fluids, certain pressure differentials between the first and second ends 148 and 150 of the activation rod 146 may cause the activation rod 146 to prematurely move from the first position to the second position and unblock the entrance 128 to the receptacle 106. For example, when drilling fluid pressure acting on the first end 148 of the activation rod 146 exceeds presaturation fluid pressure acting on the second end 150 of the activation rod 146, the activation rod 146 may tend to compress the presaturation fluid, which may move the activation rod 146 toward the second position. If the activation rod 146 reaches the second position due solely to differences in pressure between the presaturation fluid and the drilling fluid, the activation module 132 may no longer seal contaminants (e.g., drilling fluid and particles suspended in the drilling fluid) from entering the receptacle 106. Accordingly, equalizing pressure differentials between the presaturation fluid and the drilling fluid may reduce the likelihood that the receptacle will become contaminated.

Figure 2:
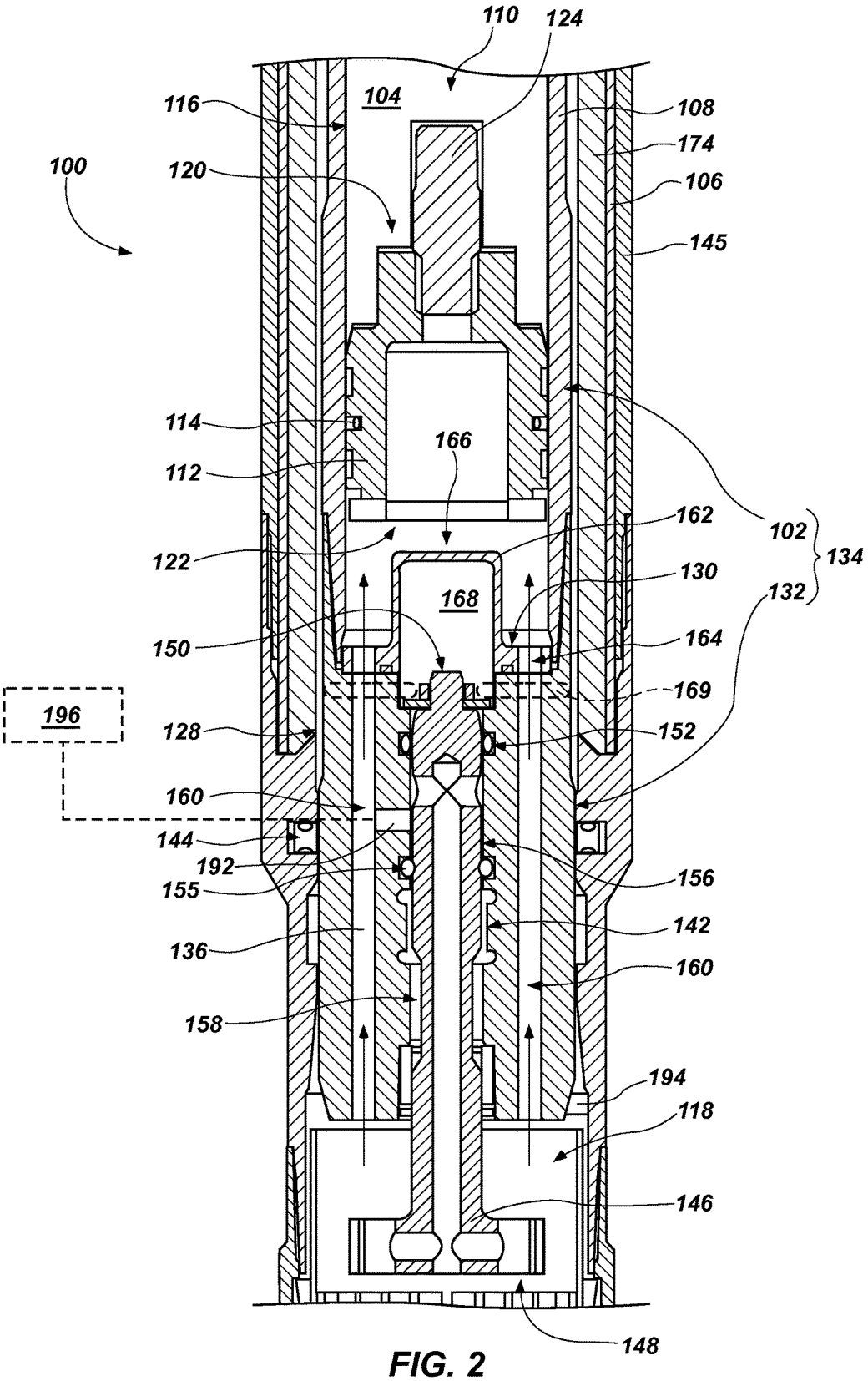
FIG. 2 is an enlarged cross-sectional view of the compensation module of FIG. 1.

Referring to FIG. 2, an enlarged cross-sectional view of a portion of the compensation module 102 of FIG. 1 is shown. The view of FIG. 2 is rotated 90° about the longitudinal axis of the tool with respect to the view of FIG. 1, hiding certain features of the activation module 132 (e.g., the locking dogs 154) and depicting certain other features of the activation module 132, as explained below. The activator body 136 may include fluid passages 160 configured to communicate drilling fluid from the exterior 118 of the receptacle 106 with the second volume of drilling fluid acting on the second side 122 of the compensating piston 112. For example, the fluid passages 160 may be located radially adjacent the inner bore 142, and both the fluid passages 160 and the inner bore 142 may extend entirely through the activator body 136. The activation module 132 may include a catch 155 configured to resist axial movement of the activation rod 146 relative to the activator body 136. For example, the catch 155 may be positioned between the activator body 136 and the activation rod 146 and may bear against the activation rod 146 to resist its axial movement. More specifically, the catch 155 may be, for example, a spring-loaded latch that presses against the activation rod 146 and resists axial movement of the activation rod 146 to reduce (e.g., eliminate) the risk that the activation rod 146 will be prematurely moved.

To ensure that the second end 150 of the activation rod 146 is exposed to the pressure of the presaturation fluid, an attachment interface member 162 may be interposed between the compensator housing 108 and the activator body 136. The attachment interface member 162 may include holes 164 that extend through the attachment interface member 162 positioned to align with the fluid passages 160 and permit drilling fluid to flow past the attachment interface member 162 to the second side 122 of the compensating piston 112. The attachment interface member 162 may be defined by a sealing member, such as, for example, a sealing plate 166 defining a space 168 exposed to the presaturation fluid. For example, the space 168 may be a channel extending crosswise to the bore 110 of the compensator housing 108. More specifically, the channel may extend in a direction at least substantially perpendicular to a longitudinal axis of the coring tool 100 through the compensator housing 108 such that the channel is exposed on both sides to the presaturation fluid between the compensator housing 108 and a sponge material 174, which may, for example, line the receptacle 106. As another example, the space 168 may be an at least substantially cylindrical space under the attachment interface member 162, which may be in fluid communication with the presaturation fluid via passages 169 extending from the space 168, through the activator body 136, to the presaturation fluid at a radial exterior of the activator body 136.

The second end 150 of the activation rod 146 may be exposed at the space 168, and the space 168 may permit the pressure exerted by the presaturation fluid to act on the second end 150 of the activation rod 146. The sealing plate 166 may enclose the second volume of drilling fluid on the second side 122 of the compensating piston 112, enabling pressure exerted by the drilling fluid to act on the compensating piston 112 such that the compensating piston 112 may reduce (e.g., minimize or eliminate) pressure differences between the drilling fluid and the presaturation fluid. In other words, the sealing plate 166 may define a fixed lower end of the second volume of fluid, and the compensating piston 112 may move to increase and decrease the second volume of drilling fluid, resulting in corresponding decreases and increases of the first volume of presaturation fluid to compensate for pressure differences between the drilling fluid and the presaturation fluid. The space 168 may be sized to accommodate the second end 150 of the activation rod 146 as the activation rod 146 moves from the first position to the second position. The attachment interface member 162 may further include the lower stop 130 adjacent to the sealing plate 166.

The space 168, the sealed portion of the interior 104 of the receptacle 106, and the bore 110 of the compensator housing 108 on the first side 120 of the compensating piston 112 may be in fluid communication with one another. For example, the sealed portion of the interior 104 of the receptacle 106 and the bore 110 of the compensator housing 108 on the first side 120 of the compensating piston 112 may be in fluid communication with one another via an opening through the upper stop 126 (see FIG. 1), such that presaturation fluid is free to flow between the sealed portion of the interior 104 of the receptacle 106 and the bore 110 of the compensator housing 108 on the first side 120 of the compensating piston 112. Similarly, the space 168 in which the second end 150 of the activation rod 146 is exposed may be in fluid communication with the sealed portion of the interior 104 of the receptacle 106 via, for example, the exposed ends of the channel or the passages 169, such that presaturation fluid is free to flow from above the compensation module 102, between an exterior of the compensator housing 108 and a sponge material 174 lining the receptacle 106, to the space 168 and vice versa. Presaturation fluid may freely flow around and exert pressure on surfaces defining the space 168, the sealed portion of the interior 104 of the receptacle 106, and the bore 110 of the compensator housing 108 on the first side 120 of the compensating piston 112.

The exterior 118 of the receptacle 106 and the bore 110 of the compensator housing 108 on the second side 122 of the compensating piston 112 may be in fluid communication with one another. For example, the exterior 118 of the receptacle 106 and the bore 110 of the compensator housing 108 on the second side 122 of the compensating piston 112 may be in fluid communication with one another via the fluid passages 160 extending through the activator body 136, such that drilling fluid is free to flow between the exterior 118 of the receptacle 106 and the bore 110 of the compensator housing 108 on the second side 122 of the compensating piston 112. The presaturation fluid and drilling fluid may not intermix, absent pressure release of the presaturation fluid through one of the one-way pressure relief valves 124 and 184 (see FIG. 4), because the seals 114, 144, and 152 and the attachment interface member 162 may seal presaturation fluid within the space 168, the sealed portion of the interior 104 of the receptacle 106, and the bore 110 of the compensator housing 108 on the first side of the compensating piston 112 and may seal drilling fluid at the exterior 118 of the receptacle 106 and the bore 110 of the compensator housing 108 on the second side of the compensating piston 112. As pressures change, and the presaturation fluid and drilling fluid flow into and out of the bore 110 of the compensator housing 108 on their respective sides of the compensating piston 112, the compensating piston 112 may move along the longitudinal length of the compensator housing 108 to compress and expand the volume occupied by the presaturation fluid and any gas sealed within the interior 104 of the receptacle 106 and reduce (e.g., minimize or eliminate) pressure differentials between the interior 104 of the receptacle 106 and the exterior 118 of the receptacle 106.

Figure 3:
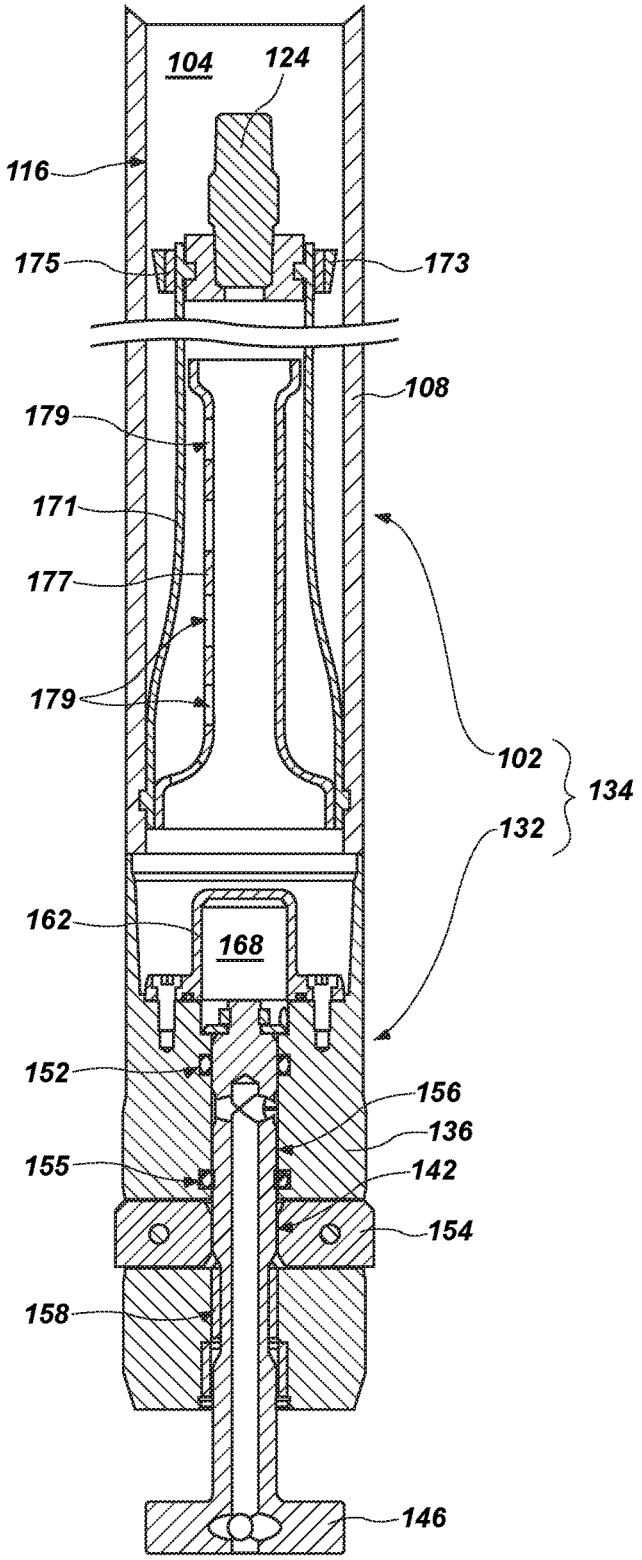
FIG. 3 is an enlarged cross-sectional view of another embodiment of a compensation module.

FIG. 3 is an enlarged cross-sectional view of another embodiment of a compensation module 102. In some embodiments, such as that shown in FIG. 3, the movable compensating member may be, for example, a flexible member 171 configured to elastically deform, expand, and compress in response to pressure differences between the presaturation fluid and the drilling fluid. For example, the flexible member 171 may be a bellows of elastically deformable material (e.g., a rubber material), which may expand and contract in response to pressure differences between the presaturation fluid and the drilling fluid. As another example, the flexible member 171 may be a bellows of movable, accordion-like members, which may unfold and refold in response to pressure differences between the presaturation fluid and the drilling fluid.

In some embodiments, the flexible member 171 may be located at least partially within the compensator housing 108. For example, a lower end of the flexible member 171 may be located within (e.g., connected or directly sealed to) the compensator housing 108, but the upper end may expand above an upper longitudinal extent of the compensator housing 108 when the pressure of the drilling fluid exceeds the pressure of the presaturation fluid. The movable compensating member may include, for example, a clamp 175 configured to connect the flexible member 171 to the one-way pressure relief valve 124. For example, the clamp 175 may be of an annular shape and may be positioned around the flexible member 171 and the one-way pressure relief valve 124 to secure them to one another. The movable compensating member may further include a guide member 173 configured to align the flexible member 171 and the one-way pressure relief valve 124 within the compensator housing 108. More specifically, the guide member 173, which may be a separate component or an integral portion of the clamp 175, may exhibit an annular shape extending around the flexible member 171 and the one-way pressure relief valve 124, and may be of a diameter at least great enough to reduce (e.g., eliminate) the likelihood that the one-way pressure relief valve 124 will become lodged or pinched within the compensator housing 108. As a specific, nonlimiting example, the guide member 173, the compensator housing 108, or both may include angled surfaces configured to enable the guide member 173 to enter the compensator housing 108 from above without becoming lodged on the upper end of the compensator housing 108. In other embodiments, the compensation module 102 may lack a compensator housing 108, and the flexible member 171 may simply be positioned within the receptacle 106 (see FIG. 1).

The compensation module 102 may include a support member 177 positioned between the flexible member 171 and the attachment interface member 162. The support member 177 may be, for example, a tube-shaped member through which drilling fluid may flow to contact the flexible member 171 and a rigid member which the one-way pressure relief valve 124 may contact when the flexible member 171 contracts. The support member 177 may include, for example, holes 179 in its sidewall, which may reduce (e.g., eliminate) the likelihood that drilling fluid will become trapped in a space between the flexible member 171 and the support member 177. In some embodiments, an uppermost surface of the support member 177 may be located longitudinally below an uppermost surface of the compensator housing 108. In other embodiments, the uppermost surface of the support member 177 may be flush with the uppermost surface of the compensator housing 108. In still other embodiments, the uppermost surface of the support member 177 may be located longitudinally below the uppermost surface of the compensator housing 108.

Figure 4:
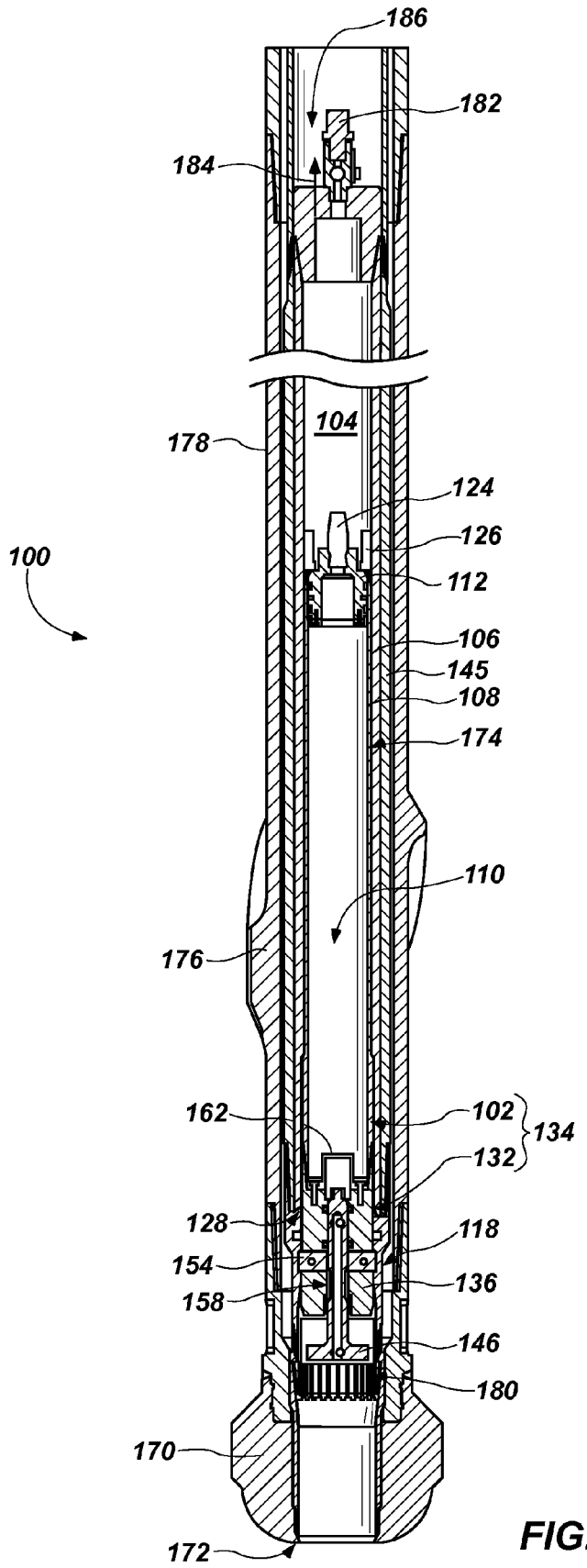
FIG. 4 is a cross-sectional view of a coring tool in a first state.

Referring to FIG. 4, a cross-sectional view of a coring tool 100 in a first state is shown. The coring tool 100 may include a coring bit 170 at a leading end of the coring tool 100. The coring bit 170 may include a cutting structure 172 configured to cut a coring sample to be received into the receptacle 106 as the coring bit 170 is advanced (e.g., by applying weight-on-bit and rotating the coring tool 100) into an earth formation. The receptacle 106 may be connected to the coring bit 170, and may be positioned to receive a core sample produced using the cutting structure 172 of the coring bit 170. The receptacle 106 may comprise, for example, a generally tubular member longitudinally trailing the coring bit 170. The receptacle 106 may be rotatable with respect to the coring bit 170, such that the receptacle 106 may remain rotationally stationary as it receives a coring sample while the coring bit 170 rotates to cut the coring sample. For example, the receptacle 106 may be connected to the coring bit 170 by a bearing (not shown) supporting the receptacle 106.

In some embodiments, the receptacle 106 may be lined with a sponge material 174 configured to capture (e.g., by absorbing) a fluid expected to be found within a core sample procured using the coring bit 170. The sponge material 174 may comprise, for example, a material wettable to a fluid of interest to be found within the core sample and an open network of pores throughout the material into which the fluid of interest may infiltrate (e.g., in the form of a foam or felt, which may use capillary action to draw fluid into the sponge material 174). As a specific, nonlimiting example, the sponge material 174 may comprise a porous, foam polyurethane material, to which oil may be wettable, proximate to (e.g., adjacent to, affixed by adhering to, or not affixed to) the receptacle 106. In embodiments where the sponge material 174 exhibits preferential wettability (i.e., more easily captures a selected fluid), the sampling of fluids within the sponge material 174 after procuring a core sample may not reflect the concentration of all fluids escaped from the core sample, but may more accurately reflect the concentration of a particular fluid of interest (e.g., oil) in the core sample. In some embodiments, the sponge material 174 and receptacle 106 (sometimes collectively referred to as a "sponge liner") may be received within (e.g., adhered to the inner surface of or simply inserted within without being affixed to) the inner barrel 145 located within an outer barrel 178 of the coring tool 100. The flow path for drilling fluid at the exterior 118 of the receptacle 106 may be defined between the inner barrel 145 and the outer barrel 178.

The coring tool 100 may include a stabilizer 176 proximate to the coring bit 170. The stabilizer 176 may extend from an outer barrel 178 connected to the coring bit 170, which may connect the coring bit 170 to a drill string and may transfer loads (e.g., axially applied weight-on-bit and rotationally applied torque) to the coring bit 170, in some embodiments. In other embodiments, one or more stabilizers may be connected to the coring tool 100 (e.g., instead of or in addition to, the stabilizer 176 incorporated into the outer barrel 178 itself). Drilling fluid may flow along the exterior 118 of the receptacle 106 within a space defined between the outer barrel 178 and the receptacle 106 to proximate the coring bit 170, where it may be free to enter the second volume on the second side 122 (see FIGS. 1, 2) of the compensating piston 112.

The coring tool 100 may include the compensation and activation unit 134 proximate the entrance 128 to the receptacle 106. For example, the compensation module 102 may be attached to the activation module 132, and the activation module 132 may be positioned below the compensation module 102 sealing the entrance 128 to the receptacle 106 shut. The activation rod 146 of the activation module 132 may be located in the first position.

The coring tool 100 may further include a core catcher 180 configured to retain a core sample within the receptacle 106 while removing the coring tool 100 and core sample from a borehole. The core catcher 180 may comprise, for example, a wedging collet. A wedge-shaped portion of the core catcher 180 may be sized and shaped to enable a core sample 190 (see FIG. 6) to pass through the core catcher 180 when traveling longitudinally upward into the receptacle 106. When the coring tool 100 begins to back out of the borehole, the wedge-shaped portion may constrict around and frictionally engage with the core sample, reducing (e.g., eliminating) the likelihood that the core sample 190 will exit the receptacle 106 after it has entered the receptacle 106.

The coring tool 100 may include a selective two-way valve 182, which may be located at an end of the receptacle 106 opposing the coring bit 170. The selective two-way valve 182 may be configured to prepare the interior 104 of the receptacle 106 to receive a presaturation fluid and to introduce the presaturation fluid into the receptacle 106. The coring tool 100 may further include a one-way pressure relief valve 184 at the upper end 186 of the receptacle 106. The one-way pressure relief valve 184 may be configured to permit presaturation fluid from the interior 104 of the receptacle 106 to escape when the pressure within the receptacle 106 exceeds an amount that can be reduced using the compensation module 102.

When assembling the coring tool 100 and preparing the coring tool 100 to be deployed in a borehole, the compensation and activation unit 134 may be positioned within the receptacle 106. The entrance 128 to the receptacle 106 may be sealed shut using the activation module 132. An at least partial vacuum may be formed within the interior 104 of the receptacle 106 through the selective two-way valve 182. Because achieving a complete vacuum is impracticable, if not impossible, some pressure may remain in the interior 104 of the receptacle 106. When the partial vacuum is produced, the compensating piston 112 or other compensating member may travel longitudinally upward to at least partially compensate for the difference in pressure between the partial vacuum at the interior 104 of the receptacle 106 and the pressure at the exterior 118 of the receptacle 106.

Figure 5:
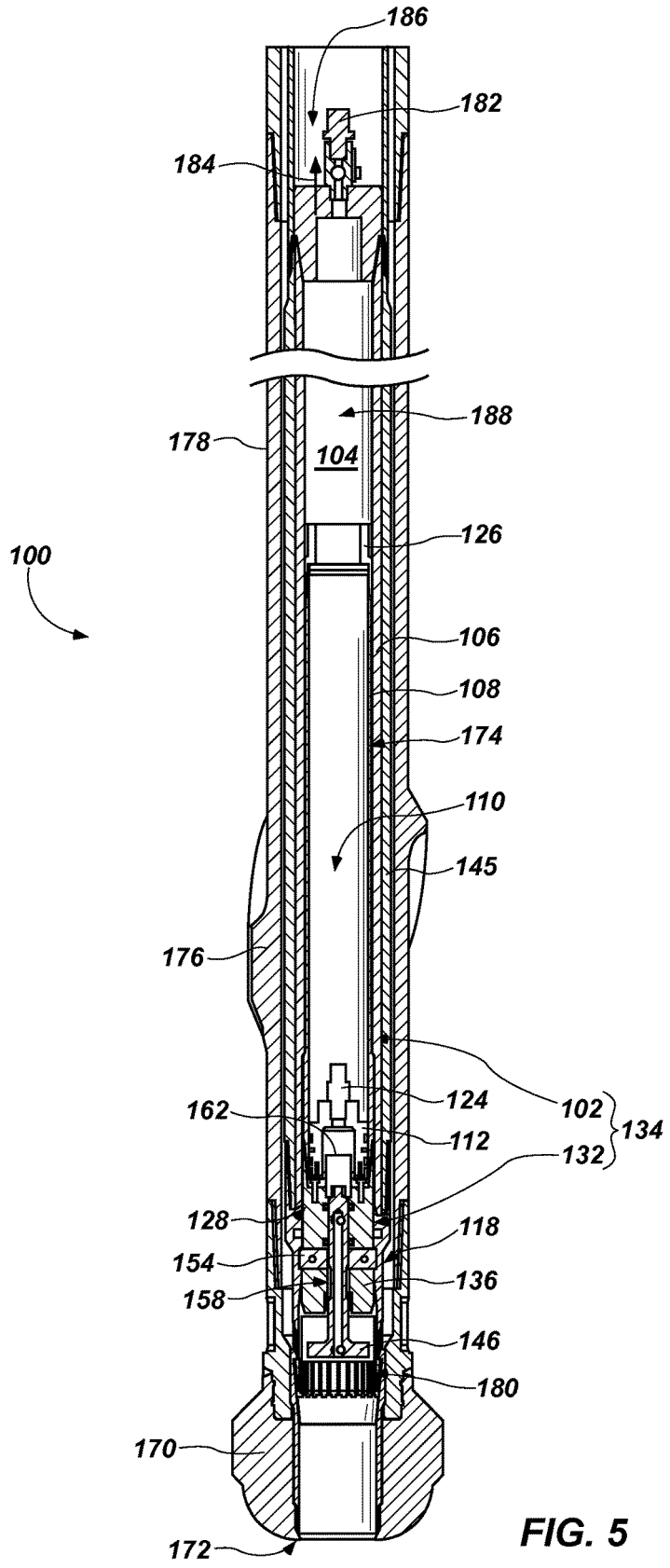
FIG. 5 is a cross-sectional view of the coring tool of FIG. 4 in a second state.

Referring to FIG. 5, a cross-sectional view of the coring tool 100 of FIG. 4 in a second state is shown. Presaturation fluid 188 may be introduced into the interior 104 of the receptacle 106 through the selective two-way valve 182. For example, presaturation fluid 188 may flow into the interior 104 of the receptacle 106 until a remaining amount of the first volume on the first side 120 (see FIG. 1) of the compensating piston 112 or other compensating member is occupied by the presaturation fluid 188. The presaturation fluid 188 may comprise, for example, a fluid not wettable to the sponge material 174. Suitable presaturation fluids 188 may include, for example, brine solutions. The increase in pressure within the interior 104 of the receptacle 106 with respect to the exterior 118 of the receptacle 106 may cause the compensating piston 112 or other compensating member to move longitudinally downward to at least partially compensate for the difference in pressure between the pressurized presaturation fluid 188 within the receptacle 106 and the pressure outside the receptacle 106. Complete saturation of the first volume may be indicated by the escape of presaturation fluid 188 through one or both of the one-way pressure relief valves 124 and 184. Because only a partial vacuum was previously produced, a portion of the first volume may be occupied by gas in addition to the presaturation fluid 188. For this reason, the first volume may compress and expand due to compression and expansion of the gas in the first volume even though the presaturation fluid 188 itself may be at least substantially incompressible. Accordingly, compression and expansion of the presaturation fluid 188, as discussed in this disclosure, means and includes compression and expansion of the first volume occupied by the presaturation fluid 188 and any gas resulting from the partial vacuum formed in the first volume before introducing the presaturation fluid 188.

After the receptacle 106 has received the pressurized presaturation fluid 188, the coring tool 100 may be introduced into a borehole and advanced toward an end of the borehole. As the coring tool 100 advances, drilling fluid may be circulated along the drill string around the exterior 118 of the receptacle 106. In the borehole, the drilling fluid may be pumped at high pressures to compensate for hydraulic losses (e.g., head loss) as depth in the borehole increases and increased temperatures may increase the pressure exerted by the presaturation fluid 188. In some situations, such as, for example, in cold and deep environments, the pressure exerted by the drilling fluid may exceed the pressure exerted by the presaturation fluid 188. Without any compensation for the pressure differential, the activation module 132 may be prematurely released by high pressure drilling fluid forcing the activation rod 146 to compress the presaturation fluid 188 and moving the activation rod 146 to the second position. The compensating piston 112 or other compensating member may compress the first volume (e.g., including the presaturation fluid 188 and the gas) to reduce (e.g., minimize) the pressure differences between the drilling fluid and the presaturation fluid 188. In other situations, such as in hot and shallow environments, the pressure exerted by the drilling fluid may be less than the pressure exerted by the presaturation fluid 188. The compensating piston 112 or other compensating member may expand the first volume (e.g., including the presaturation fluid 188 and the gas) to reduce (e.g., minimize) the pressure differences between the drilling fluid and the presaturation fluid 188. If there is no more room to expand, some of the presaturation fluid 188 may escape through one or both of the one-way pressure relief valves 124 and 184 to maintain pressure equilibrium.

Figure 6:
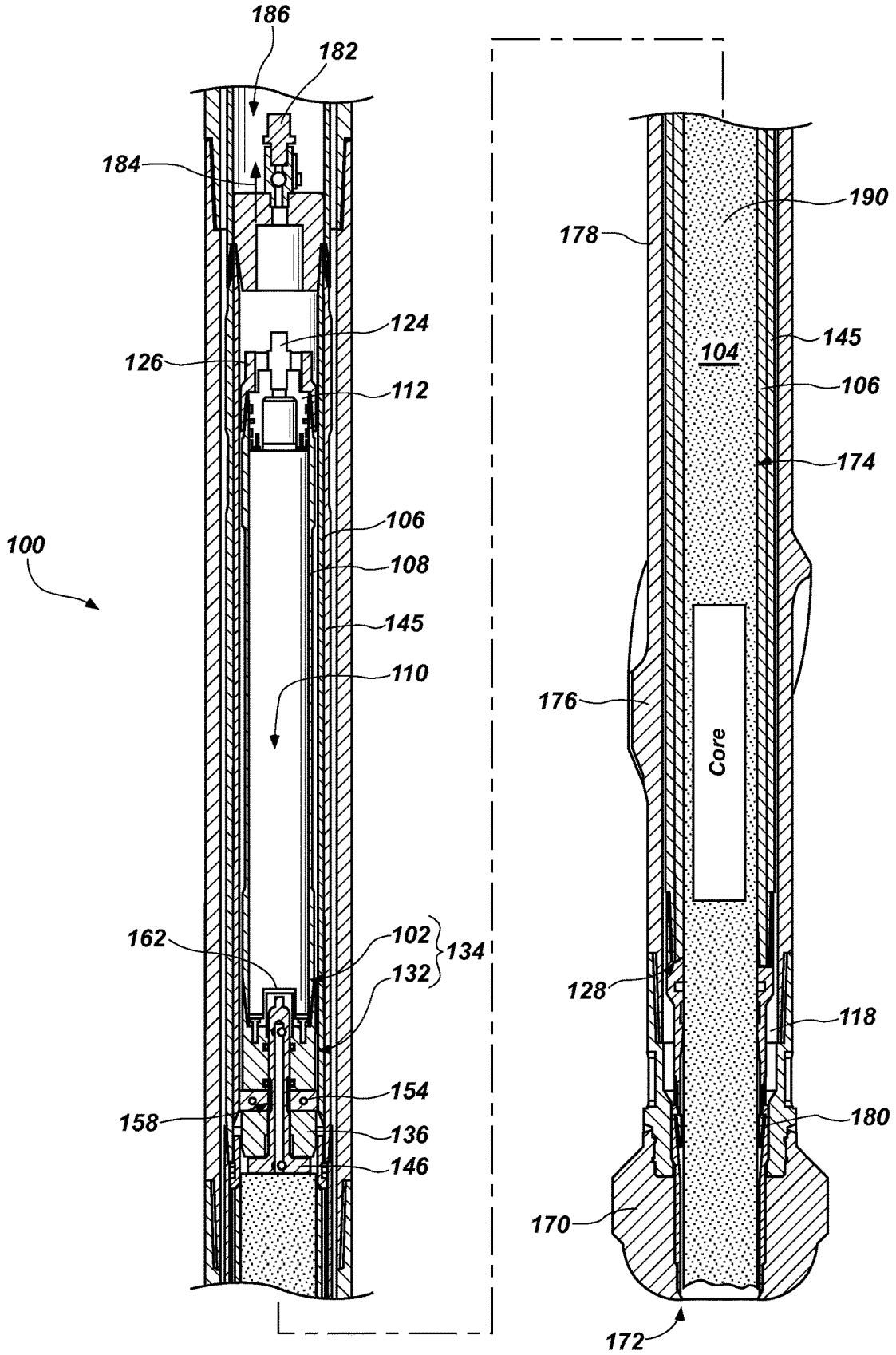
FIG. 6 is a cross-sectional view of the coring tool of FIG. 4 in a third state.

Referring to FIG. 6, a cross-sectional view of the coring tool 100 of FIG. 4 in a third state is shown. When the coring tool 100 reaches the end of the borehole, the coring bit 170 may begin cutting a core sample 190. The core sample 190 may contact the activation rod 146, moving the activation rod 146 to the second position and releasing the locking dogs 154. The activation module 132 may be released, and the entrance 128 to the receptacle 106 may be unblocked as the compensation and activation unit 134 rides on top of the advancing core sample 190 being inserted into the receptacle 106. Additional longitudinal space may be provided within the receptacle 106 to accommodate the compensation and activation unit 134.

Alternatively, and referring collectively to FIGS. 1, 2, and 5, the release of the activation module 132 may be caused by at least one actuator 192 that actuates the locking dogs 154 to release the activation module 132 while at least substantially at the same time establishing fluid communication between the presaturation fluid 188 and the drilling fluid. The actuator 192 may actuate the locking dogs 154 or may cause the actuation of the locking dogs 154 in response to a signal from a sensor 194 configured to detect the progress of the core sample 190 into the coring tool 100 or, in addition or alternatively, a signal that was transmitted by an operator from the surface to a receiver 196 (e.g., a transceiver) to release the activation module 132. For example, the actuator 192 may actuate the actuating rod 146 to move it to the position where locking dogs 154 are moved into the recesses 158 of the actuating rod 146 and fluid communication between presaturation fluid 188 and drilling fluid is established through channels in response to a sensor 194, sensing the progress of the core sample 190 advancement into the coring tool 100 or receiving a signal that is created by an operator, such as an electric signal or a pressure signal, at the receiver 196 (e.g., using mud pulse telemetry, electromagnetic telemetry, wired pipe telemetry, acoustic telemetry, or any other suitable method to convey signals from the surface to a downhole location). Actuating the locking dogs 154 and establishing fluid communication substantially at the same time means that fluid communication is established when the activation module 132 starts to move into the receptacle 106 while the core 190 advances into the coring tool 100. In one embodiment, the fluid communication between the presaturation fluid 188 and the drilling fluid is established shortly before the activation module 132 starts to move into the axial direction to ensure that the movement of the activation module 132 is not hampered by fluid that is sealed within the receptacle 106 (e.g., presaturation fluid 188).

Those skilled in the art will appreciate that the invention described above is an embodiment of a boundary between the drilling fluid and the presaturation fluid that prevents mixing between these fluids and that is at least in some sense movable to compensate at least partly for pressure differences between the interior 104 of the receptacle 106 and the exterior 118 of the receptacle 106106. While the beforementioned embodiment realizes the movable boundary between drilling fluid and presaturation fluid 188 by a compensating piston 112 that is movable inside a compensator housing 108, the same functionality can be achieved with a bellow (e.g., the flexible member 171 of FIG. 3) replacing the compensating piston 112 inside the compensator housing 108, the bellow being made of a flexible material (e.g., an elastically deformable material), such as, for example, an elastomer, a steel or other metal, or any other suitable material that can withstand the downhole conditions, the bellow being sealably connected to the activation module 132 and the bellow being elastic at least to some extent to allow adjacent fluids to be expanded or compressed in response to pressure differentials. In such a configuration, the bellow might be sealably attached to the inner surface of the compensator housing or to the inner surface of the inner barrel 145 or might be directly attached to the activation module 132. The relief valve 124 might be incorporated to provide the same functionality as described above. In addition, the bellow might be used in combination with the compensating piston 112 such as using both parts in parallel.

While the description and the figures describe the compensation module 102 installed within the lower part of the receptacle 106 those skilled in the art will appreciate that the compensation module might be installed at other locations as well. For example, the compensation module 102 might be installed below the receptacle 106. As another example, the compensation module 102 might be installed at or near the upper end of the receptacle 106. As yet another example, the compensation module 102 might be installed above the upper end of the receptacle 106.

Additional, nonlimiting embodiments within the scope of this disclosure include:

Embodiment 1

A coring system, comprising: a coring bit configured to cut a core sample from an earth formation; an inner barrel connected to the coring bit, the inner barrel comprising a receptacle configured to receive the core sample; a first fluid configured to presaturate the receptacle; a second fluid configured to cool and lubricate the coring bit; and a compensation module positioned between the first fluid and the second fluid, the compensation module being configured to reduce pressure differences between the first fluid and the second fluid over a range of pressure differences, the compensation module comprising: a fluid boundary connected to the inner barrel and positioned to seal the first fluid from the second fluid, the fluid boundary being movable to enable expansion or compression of the first fluid in response to pressure differences across the fluid boundary.

Embodiment 2

The coring system of Embodiment 1, further comprising a selectively releasable activation module positioned to seal the first fluid from the second fluid.

Embodiment 3

The coring system of Embodiment 2, wherein an inner surface of the receptacle is lined with a material configured to capture a fluid.

Embodiment 4

The coring system of Embodiment 3, wherein the material configured to capture the fluid comprises at least one of a sponge, a felt, a foam, and a combination thereof.

Embodiment 5

The coring system of any one of Embodiments 1 through 4, wherein the fluid boundary comprises a flexible member configured to elastically default, expand, or compress in response to pressure differences between the first fluid and the second fluid.

Embodiment 6

The coring system of any one of Embodiments 1 through 4, wherein the fluid boundary comprises: a compensator housing, a bore extending through the compensator housing; and a compensating piston located within the bore of the compensator housing, a seal being formed between the compensating piston and an inner surface of the compensator housing, the compensating piston being movable relative to the compensator housing to reduce pressure differences between the first fluid and the second fluid over a range of pressure differences.

Embodiment 7

The coring system of any one of Embodiments 2 through 6, wherein a lowest point of the compensation module is located 20 feet or less from an uppermost point of the activation module.

Embodiment 8

The coring system of any one of Embodiments 2 through 7, wherein the activation module is connected to the inner barrel and configured to release from and move with respect to the inner barrel in response to a core sample advancing into the coring tool.

Embodiment 9

The coring system of any one of Embodiments 2 through 8, further comprising an actuator configured to release the activation module in response to a signal.

Embodiment 10

The coring system of any one of Embodiments 2 through 9, wherein the activation module is connected to the inner barrel and configured to release from and move with respect to the inner barrel and the activation module enables fluid communication between the first fluid and the second fluid when the activation module is released from the inner barrel.

Embodiment 11

The coring system of any one of Embodiments 2 through 10, wherein the activation module comprises an activation rod sealingly connected to an activator body of the activation module, the activation rod configured to move from a first position to a second position, the activation module being connected to the inner barrel and the first fluid being sealed from the second fluid when the activation rod is in the first position, the activation module being disconnected from the inner barrel and the first fluid being in fluid communication with the second fluid when the activation rod is in the second position.

Embodiment 12

The coring system of Embodiment 11, wherein the activation rod comprises at least one recess configured to receive a locking element when the activation rod is in the second position; and at least one opening positioned to establish fluid communication between the first fluid and the second fluid when the activation rod is in the second position.

Embodiment 13

A method of making a coring system, comprising: configuring a coring bit to cut a core out of an earth formation; connecting an inner barrel comprising a receptacle configured to receive the core sample to the coring bit; presaturating the receptacle utilizing a first fluid; providing a second fluid to cool and lubricate the coring bit; and positioning a compensation module between the first fluid and the second fluid, the compensation module being configured to reduce pressure differences between the first fluid and the second fluid over a range of pressure differences, the compensation module comprising: a fluid boundary connected to the inner barrel and positioned to seal the first fluid from the second fluid, the fluid boundary being movable to enable expansion or compression of the first fluid in response to pressure differences across the fluid boundary.

Embodiment 14

A compensation unit for a coring tool, comprising: a compensation module configured to reduce pressure differences between an interior of an inner barrel and an exterior of the inner barrel over a range of pressure differences, the compensation module comprising: a compensator housing comprising a bore extending through the compensator housing; and a compensating member connected to the compensator housing, a seal being formed between the compensating member and a surface of the compensator housing, a first volume on a first side of the compensating member being configured to contain a first fluid and a second volume on a second side of the compensating member being configured to be exposed to a second fluid, the compensating member being movable with respect to the compensator housing to reduce pressure differences across the compensating member over the range of pressure differences.

Embodiment 15

The compensation unit of Embodiment 14, further comprising: an activation module configured to selectively seal an entrance to the inner barrel for receiving a core sample, the activation module comprising: an activator body sized and configured to occupy the entrance to the inner barrel; and an activation rod connected to the activator body, the activation rod comprising a first end oriented to face a core sample and a second, opposing end, a seal being formed between the activation rod and a surface of the activator body, the activation rod being movable between a first position in which the activation module seals the entrance to the inner barrel and a second position in which the activation module releases the seal.

Embodiment 16

The compensation unit of Embodiment 15, wherein the sealing member of the attachment interface member further defines a channel in fluid communication with the first volume on the first side of the compensating piston, the second end of the activation rod being exposed at the channel.

Embodiment 17

The compensation unit of Embodiment 15 or Embodiment 16, wherein the activation rod comprises a recess extending around the activation rod, and wherein the activation module further comprises locking dogs configured to secure the activation module in place when the activation rod is in the first position, the locking dogs being misaligned from the recess when the activation rod is in the first position and aligned with the recess when the activation rod is in the second position.

Embodiment 18

The compensation unit of any one of Embodiments 14 through 17, wherein the compensating piston further comprises a one-way pressure relief valve enabling fluid to pass from the first side of the piston to the second side of the piston when a pressure difference between the first side and the second side of the piston exceeds a threshold amount.

Embodiment 19

A coring tool, comprising: a coring bit comprising a cutting structure configured to cut a core sample; a receptacle connected to the coring bit, the receptacle being configured to receive a core sample within a bore of the receptacle; and a compensation module configured to equalize pressure differences between an interior of the receptacle and an exterior of the receptacle over a range of pressure differences, the compensation module comprising: a compensator housing comprising a bore extending through the compensator housing; and a compensating piston located within the bore of the compensator housing, a seal being formed between the compensating piston and an inner surface of the compensator housing defining the bore, a first volume on a first side of the compensating piston configured to be exposed to a presaturation fluid from within the receptacle and a second volume on a second side of the piston configured to be exposed to drilling fluid from outside the receptacle, the compensating piston being movable along the compensator housing to equalize pressure differences between the interior of the receptacle and the exterior of the receptacle over the range of pressure differences.

Embodiment 20

The coring tool of Embodiment 19, further comprising an activation module positioned to selectively seal an entrance to the receptacle proximate the coring bit, the activation module comprising: an activator body comprising an inner bore and fluid passages extending through the activator body, the compensator housing sealing the entrance to the receptacle, the fluid passages being in fluid communication with the second volume on the second side of the compensating piston; and an activation rod located partially within the inner bore of the activator body, the activation rod comprising a first end configured to be contacted by a core sample and a second, opposing end, a seal being formed between the activation rod and an inner surface of the activator body defining the inner bore, the activation rod being movable between a first position in which the activation module maintains the seal at the entrance to the receptacle and a second position in which the activation module releases the seal.

Embodiment 21

The coring tool of Embodiment 20, further comprising an attachment interface member positioned between the compensator housing and the activator body, the attachment interface member comprising holes providing fluid communication from the fluid passages of the activator body to the volume on the second side of the compensating piston, the attachment interface member further comprising a sealing plate isolating the second volume on the second side of the compensating piston from the first volume on the first side of the compensating piston.

Embodiment 22

The coring tool of Embodiment 21, wherein the sealing plate of the attachment interface member further defines a channel in fluid communication with the first volume on the first side of the compensating piston, the second end of the activation rod being exposed at the channel.

Embodiment 23

The coring tool of Embodiment 21 or Embodiment 22, wherein the activation rod comprises a recess extending around the activation rod, and wherein the activation module further comprises locking dogs configured to secure the activation module in place when the activation rod is in the first position, the locking dogs being misaligned from the recess when the activation rod is in the first position and aligned with the recess when the activation rod is in the second position.

Embodiment 24

The coring tool of any one of Embodiments 19 through 23, wherein the compensating piston further comprises a one-way pressure relief valve enabling fluid to pass from the first side of the piston to the second side of the piston when a pressure difference between the first side and the second side of the piston exceeds a threshold amount.

Embodiment 25

The coring tool of any one of Embodiments 19 through 24, further comprising a one-way pressure relief valve located at an upper end of the receptacle, the one-way pressure relief vale enabling fluid to pass from the first side of the piston to the exterior of the receptacle when a pressure difference between the first side and the second side of the piston exceeds a threshold amount.

Embodiment 26

A method of compensating pressure differences between an interior and an exterior of an inner barrel of a coring tool, comprising: advancing a coring tool into a wellbore, the coring tool comprising an inner barrel configured to receive a core sample cut by the coring tool, the inner barrel comprising a first fluid sealed within the inner barrel; flowing a second fluid along an exterior of the inner barrel, the second fluid configured to cool and lubricate at least a portion of the coring tool; and reducing a pressure difference between the first fluid and the second fluid over a range of pressure differences, comprising at least one of: compressing a volume occupied by the first fluid by moving at least a portion of a compensating member in a first direction in response to a pressure difference across the compensating member, the compensating member sealably connected to the inner barrel, the compensating member being exposed to the first fluid on a first side of the compensating member and exposed to the second fluid on a second, opposing side of the compensating member; and expanding the volume occupied by the first fluid by moving the at least a portion of the compensating member in a second direction in response to a pressure difference across the compensating member.

Embodiment 27

The method of Embodiment 26, further comprising releasing the first fluid into the second fluid using a one-way pressure release valve located on the compensating member.

Embodiment 28

The method of Embodiment 26 or Embodiment 27, wherein moving the at least a portion of the compensating member comprises axially displacing a piston in response to a pressure difference across the compensating member.

Embodiment 29

The method of Embodiment 26 or Embodiment 27, wherein moving the at least a portion of the compensating member comprises elastically deforming a flexible member in response to a pressure difference across the compensating member.

Embodiment 30

The method of any one of Embodiments 26 through 29, further comprising releasing presaturation fluid into the drilling fluid using a one-way pressure release valve located at an upper end of a receptacle.

Embodiment 31

The method of any one of Embodiments 29 and 30, wherein reducing the pressure difference between the presaturation fluid and the drilling fluid over the range of pressure differences comprises reducing the pressure difference at opposing ends of an activation module, the activation module being configured to seal an entrance to the receptacle when an activation rod of the activation module is in a first position and to unseal the entrance to the receptacle when the activation rod is in a second position.

Embodiment 32

The method of Embodiment 31, wherein reducing the pressure difference at the opposing ends of the activation module comprises reducing a pressure difference between the presaturation fluid within a channel at which a first end of the activation rod is exposed with the drilling fluid, the channel being defined by a sealing plate of an interface attachment located between the compensation module and the activation module.

Embodiment 33

The method of Embodiment 31 or Embodiment 32, wherein compressing the volume occupied by the presaturation fluid comprises flowing drilling fluid through fluid passages extending through the activation module to increase a volume of drilling fluid on the second side of the compensating member.

Embodiment 34

The method of any one of Embodiments 27 through 33, wherein expanding the volume occupied by the presaturation fluid comprises flowing drilling fluid to decrease a volume of drilling fluid on the second side of the compensating member through fluid passages extending through the activation module.

Embodiment 35

The method Embodiment 28, wherein moving the at least a portion of the compensating member in the first direction comprises moving the piston in a direction opposing a direction in which the coring tool is advanced into the wellbore and wherein moving the at least a portion of the compensating member in the second direction comprises moving the piston in the same direction in which the coring tool is advanced into the wellbore.

Embodiment 36

The method of any one of Embodiments 26 through 28 and 30 through 35, wherein moving the at least a portion of the compensating member in the second, opposing direction comprises wiping drilling fluid from the inner wall of the compensator housing using the seal formed against the inner wall.

While certain illustrative embodiments have been described in connection with the figures, those of ordinary skill in the art will recognize and appreciate that the scope of this disclosure is not limited to those embodiments explicitly shown and described herein. Rather, many additions, deletions, and modifications to the embodiments described herein may be made to produce embodiments within the scope of this disclosure, such as those hereinafter claimed, including legal equivalents. In addition, features from one disclosed embodiment may be combined with features of another disclosed embodiment while still being within the scope of this disclosure, as contemplated by the inventors.

What is claimed is:

1. A coring system, comprising:

a coring bit configured to cut a core sample from an earth formation;

an inner barrel connected to the coring bit, the inner barrel comprising a receptacle configured to receive the core sample;

a first fluid configured to presaturate the receptacle;

a second fluid configured to cool and lubricate the coring bit;

an activation module configured to selectively obstruct an entrance to the inner barrel, the activation module comprising at least one fluid passage extending longitudinally through the activation module; and a compensation module positioned to be between the first fluid and the second fluid, the at least one fluid passage of the activation module positioned to expose the compensation module to the second fluid on a side of the compensation module proximate to the activation module, the compensation module being configured to reduce pressure differences between the first fluid and the second fluid over a range of pressure differences, the compensation module comprising:

a fluid boundary connected to the inner barrel and positioned to seal the first fluid from the second fluid, the fluid boundary being movable to enable expansion or compression of the first fluid in response to pressure differences across the fluid boundary.

2. The coring system of claim 1, wherein an inner surface of the receptacle is lined with a material configured to capture a fluid.

3. The coring system of claim 2, wherein the material configured to capture the fluid comprises at least one of a sponge, a felt, a foam, and a combination thereof.

4. The coring system of claim 2, wherein the fluid boundary comprises a flexible member configured to elastically deform, expand, or compress in response to pressure differences between the first fluid and the second fluid.

5. The coring system of claim 2, wherein the fluid boundary comprises:

a compensator housing comprising a bore extending through the compensator housing; and a compensating piston located within the bore of the compensator housing, a seal being formed between the compensating piston and the compensator housing, the compensating piston being movable relative to the compensator housing to reduce pressure differences across the fluid boundary over a range of pressure differences.

6. The coring system of claim 2, wherein a lowest point of the compensation module is located 20 feet or less from an uppermost point of the activation module.

7. The coring system of claim 2, wherein the activation module is connected to the inner barrel and configured to release from and move with respect to the inner barrel in response to a core sample advancing into the coring bit.

8. The coring system of claim 2, further comprising an actuator configured to release the activation module in response to a signal.

9. The coring system of claim 2, wherein the activation module is releasably connected to the inner barrel and configured to release from and move with respect to the inner barrel and the activation module enables fluid communication between the first fluid and the second fluid when the activation module is released from the inner barrel in response to advancement of a core sample against the activation module.

10. The coring system of claim 2, wherein the activation module comprises an activation rod sealingly connected to an activator body of the activation module, the activation rod configured to move from a first position to a second position, the activation module being connected to the inner barrel and the first fluid being sealed from the second fluid when the activation rod is in the first position, the activation module being disconnected from the inner barrel and the first fluid being in fluid communication with the second fluid when the activation rod is in the second position.

11. The coring system of claim 10, wherein the activation rod comprises at least one recess configured to receive a locking element when the activation rod is in the second position; and at least one opening positioned to establish fluid communication between the first fluid and the second fluid when the activation rod is in the second position.

12. A method of making a coring system, comprising:

configuring a coring bit to cut a core out of an earth formation;

connecting an inner barrel comprising a receptacle configured to receive the core sample to the coring bit;

presaturating the receptacle utilizing a first fluid;

providing a second fluid to cool and lubricate the coring bit;

positioning an activation module to selectively obstruct an entrance to the inner barrel, the activation module comprising at least one fluid passage extending longitudinally through the activation module; and positioning a compensation module between the first fluid and the second fluid, the at least one fluid passage of the activation module exposing the compensation module to the second fluid on a side of the compensation module proximate to the activation module, the compensation module being configured to reduce pressure differences between the first fluid and the second fluid over a range of pressure differences, the compensation module comprising:

a fluid boundary connected to the inner barrel and positioned to seal the first fluid from the second fluid, the fluid boundary being movable to enable expansion or compression of the first fluid in response to pressure differences across the fluid boundary.

13. A compensation unit for a coring tool, comprising:

a compensation module configured to reduce pressure differences between an interior of an inner barrel and an exterior of the inner barrel over a range of pressure differences, the compensation module comprising:

a compensator housing comprising a bore extending through the compensator housing; and a compensating member connected to the compensator housing, a seal being formed between the compensating member and a surface of the compensator housing, a first volume on a first side of the compensating member being configured to contain a first fluid and a second volume on a second side of the compensating member being configured to be exposed to a second fluid, at least a portion of the compensating member being movable with respect to the compensator housing to reduce pressure differences across the compensating member over the range of pressure differences; and an activation module configured to selectively obstruct an entrance to the inner barrel for receiving a core sample, the activation module comprising:

an activator body sized and configured to occupy the entrance to the inner barrel;

at least one fluid passage extending longitudinally through the activation module, the at least one fluid passage positioned to expose the compensation module to the second fluid on a side of the compensation module proximate to the activation module; and an activation rod connected to the activator body, the activation rod comprising a first end oriented to face a core sample and a second, opposing end, a seal being formed between the activation rod and the activator body, the activation rod being movable between a first position in which the activation module seals the entrance to the inner barrel and a second position in which the activation module releases the seal.

14. A method of compensating pressure differences between an interior and an exterior of an inner barrel of a coring tool, comprising:

advancing a coring tool into a wellbore, the coring tool comprising an inner barrel configured to receive a core sample cut by the coring tool, the inner barrel comprising a first fluid sealed within the inner barrel;

flowing a second fluid along an exterior of the inner barrel, the second fluid configured to cool and lubricate at least a portion of the coring tool; and reducing a pressure difference between the first fluid and the second fluid over a range of pressure differences, comprising at least one of:

compressing a volume occupied by the first fluid by moving at least a portion of a compensating member in a first direction in response to a pressure difference across the compensating member, the compensating member sealably connected to the inner barrel, the compensating member being exposed to the first fluid on a first side of the compensating member and exposed to the second fluid via at least one passage extending through an activation module configured to selectively obstruct an entrance to the inner barrel on a second, opposing side of the compensating member proximate to the activation module; and expanding the volume occupied by the first fluid by moving the at least a portion of the compensating member in a second direction in response to a pressure difference across the compensating member.

15. The method of claim 14, further comprising releasing the first fluid into the second fluid using a one-way pressure release valve located on the compensating member.

16. The method of claim 14, wherein moving the at least a portion of the compensating member comprises axially displacing a piston in response to a pressure difference across the compensating member.

17. The method of claim 14, wherein moving the at least a portion of the compensating member in the second direction comprises wiping drilling fluid from the inner wall of the compensator housing using the seal formed against the inner wall.

18. The method of claim 14, wherein moving the at least a portion of the compensating member in the second direction comprises wiping drilling fluid from an inner wall of the compensator housing using the seal formed against the inner wall.

* * * * *